US005287980A

United States Patent [19]

Saltz

[11] Patent Number: 5,287,980

[45] Date of Patent: Feb. 22, 1994

[54] TICKET DISPENSER ASSEMBLY INCLUDING INTERLOCKING DISPENSER UNITS

[75] Inventor: Edward B. Saltz, Brookfield, Wis.

[73] Assignee: Eddy Associates, Inc., New Berlin, Wis.

[21] Appl. No.: 899,728

[22] Filed: Jun. 17, 1992

[51] Int. Cl.[5] ..... B65D 6/00

[52] U.S. Cl. ..... 220/4.27; 220/23.83; 220/630; 220/636; 206/509; 206/511; 248/127; 248/146; 248/150

[58] Field of Search ..... 220/4.27, 23.4, 23.6, 220/630, 636, 23.83; 206/509, 511, 512; 248/127, 146, 150

[56] References Cited

U.S. PATENT DOCUMENTS

| | | | |
|---|---|---|---|
| 758,023 | 4/1904 | Siebler . | |
| 978,052 | 12/1910 | Oehring . | |
| 994,081 | 5/1911 | Lipes . | |
| 1,026,605 | 5/1912 | Rickert . | |
| 1,287,122 | 12/1918 | Skeri . | |
| 1,339,823 | 5/1920 | Harbaugh . | |
| 1,379,756 | 5/1921 | Friend . | |
| 1,400,619 | 12/1921 | Marcuse . | |
| 1,658,608 | 2/1928 | Marcuse . | |
| 2,207,873 | 7/1940 | Parr | 164/84.5 |
| 2,807,387 | 9/1957 | Siciliano | 206/509 X |
| 2,809,082 | 10/1957 | Marcuse | 312/39 |
| 2,887,247 | 5/1959 | Williams, Jr. | 221/25 |
| 3,182,856 | 5/1965 | Goltz | 220/4.27 X |
| 3,194,426 | 7/1965 | Brown, Jr. | 220/23.4 |
| 3,219,400 | 11/1965 | Bergquist | 220/23.6 X |
| 3,249,273 | 5/1966 | Robinson | 225/16 |
| 3,351,005 | 11/1967 | Giori | 101/77 |
| 3,653,734 | 4/1972 | Ungaro | 206/509 X |
| 3,776,134 | 12/1973 | Wenger | 101/226 |
| 3,978,958 | 9/1976 | Zandstra | 194/2 |
| 3,983,578 | 9/1976 | Price | 360/1 |
| 4,402,424 | 9/1983 | Mattix | 221/13 |
| 4,516,711 | 5/1985 | Barege | 225/20 |
| 4,568,211 | 2/1986 | Fox et al. | 400/621 |
| 4,592,669 | 6/1986 | Lohse et al. | 400/621 |
| 4,624,383 | 11/1986 | Moore | 220/23.4 |
| 4,718,654 | 1/1988 | Ehlers | 270/52.5 |
| 4,738,384 | 4/1988 | Tigner | 225/16 |
| 4,793,253 | 12/1988 | Han | 101/329 |
| 4,800,812 | 1/1989 | Lin | 101/226 |
| 4,821,642 | 4/1989 | Schafer | 101/219 |
| 4,858,806 | 8/1989 | Schafer | 225/32 |
| 4,995,507 | 2/1991 | Schafer | 206/39.7 |
| 5,100,038 | 3/1992 | Schafer | 225/32 |
| 5,111,939 | 5/1992 | Schafer | 206/503 |

*Primary Examiner*—Allan N. Shoap
*Assistant Examiner*—Paul A. Schwarz
*Attorney, Agent, or Firm*—Michael, Best & Friedrich

[57] ABSTRACT

A lottery ticket dispenser assembly including a plurality of modularly constructed dispenser units arranged in vertically stacked, interlocking relation. The dispenser units each include sets of rails which are engageable with complementary sets of rails on adjacent dispenser units to interlock the dispenser units for sliding movement relative to one another. Each dispenser unit also includes a door which, when closed, prevents the rails of adjacent dispenser units from being disengaged to prevent unauthorized personnel from disassembling the dispenser assembly.

14 Claims, 3 Drawing Sheets

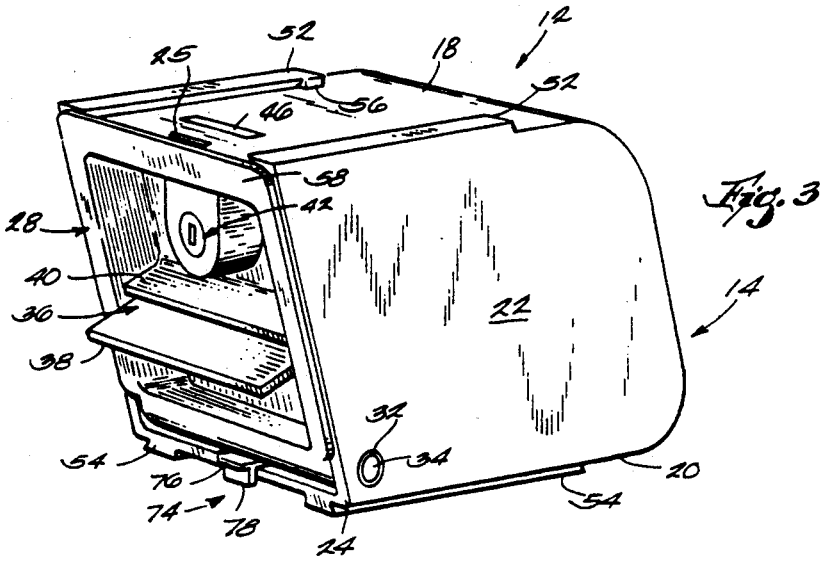
Fig. 3
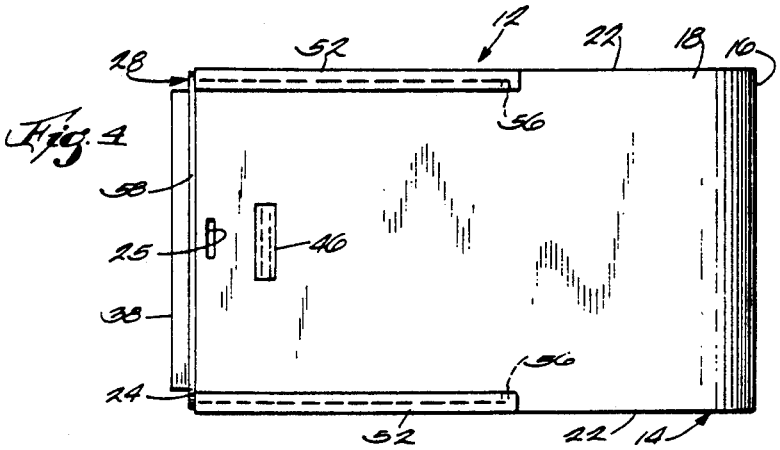
Fig. 4
Fig. 5
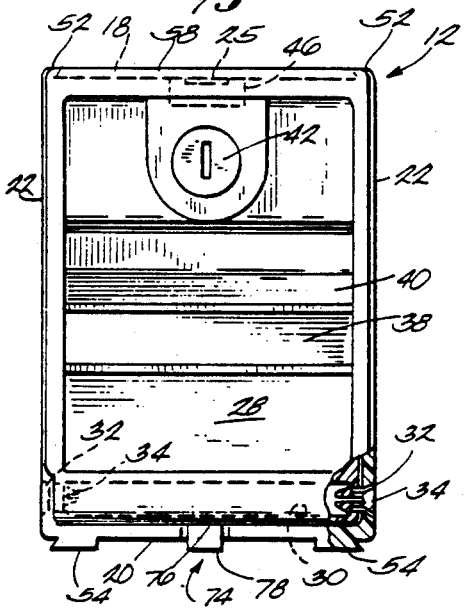
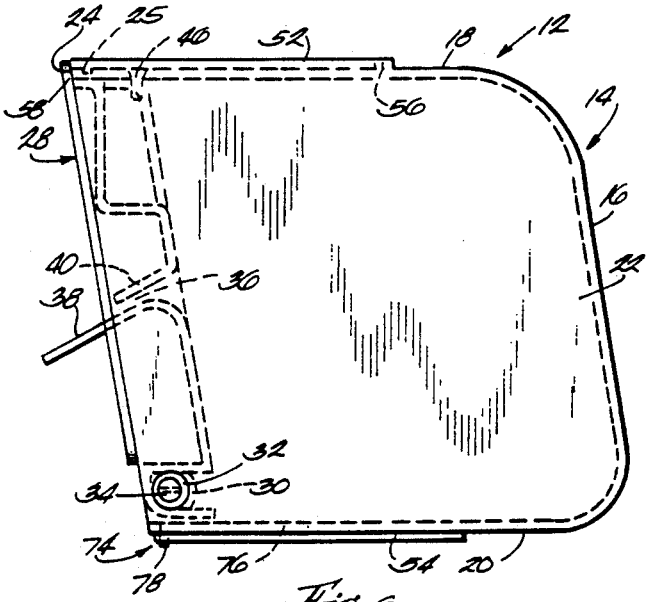
Fig. 6

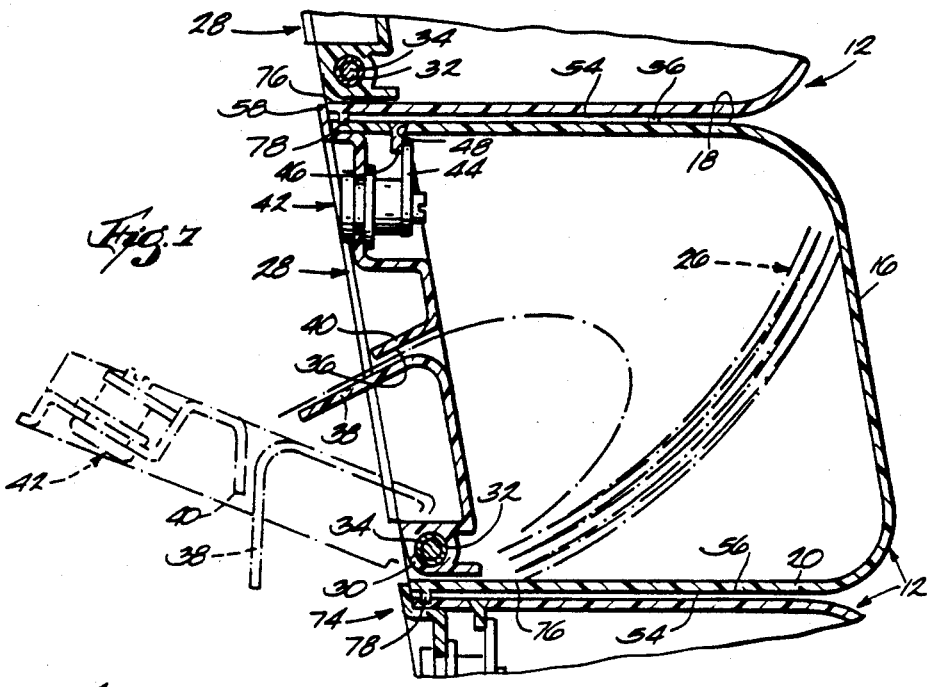
Fig. 7
Fig. 8
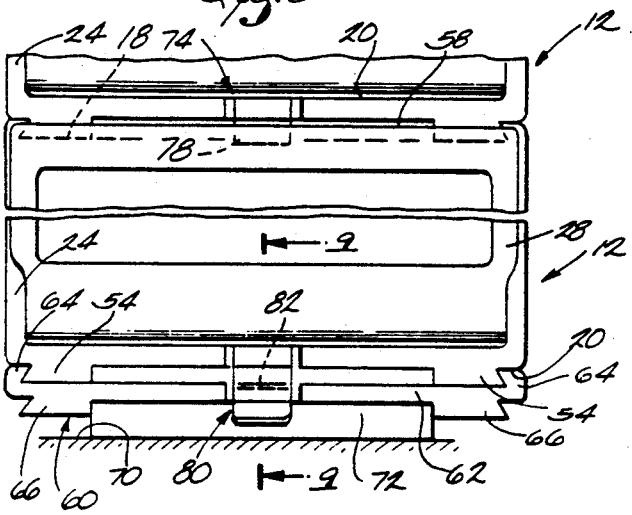
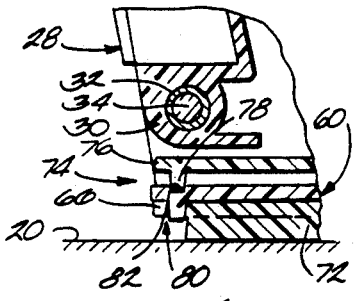
Fig. 9
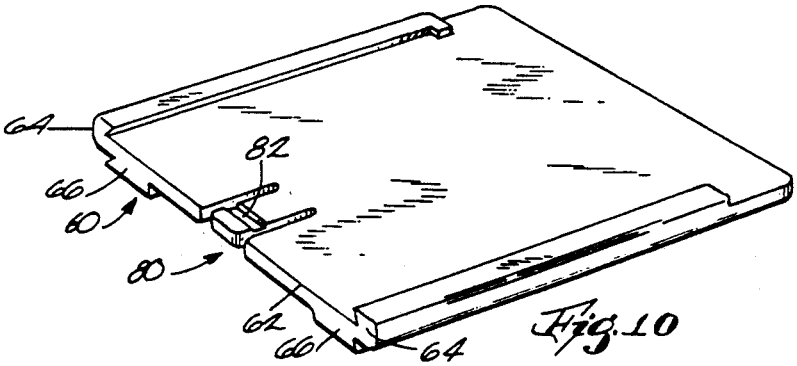
Fig. 10

TICKET DISPENSER ASSEMBLY INCLUDING INTERLOCKING DISPENSER UNITS

BACKGROUND OF THE INVENTION

1. Field of the Invention

The invention relates to ticket dispensers such as lottery ticket dispensers and the like, and more particularly to ticket dispensers which are stackable one on top of another.

2. Reference to Prior Art

A ticket dispenser used to dispense lottery tickets typically includes a container for holding a plurality of tickets, a door and a slot through which the tickets can be dispensed. Where it is desired to display different types of tickets for playing different lottery games, it is known to place dispenser units on top of one another in vertically stacked relation with adjacent units bonded together using two-sided tape.

SUMMARY OF THE INVENTION

In prior art ticket dispensing arrangements wherein dispenser units are secured together with two-sided tape, it is difficult to disassemble the dispenser units from each other without damaging or marring the units. Additionally, two-sided tape poses for authorized personnel the same difficulty with respect to separating taped together units as is faced by unauthorized personnel.

A principal feature of the invention is the provision of improved ticket dispensers which can be easily assembled in fixed and locked relation to form a ticket dispenser assembly. In a preferred arrangement, the dispensers are assembled in vertically stacked relation. The dispensers are also easily disconnectable from each other by authorized personnel to take down the assembly. Each dispenser includes upper and lower sets of rails which are engageable with complementary sets of rails on adjacent dispenser units to interlock the dispenser units for sliding movement relative to one another. Each dispenser also includes a door which, when closed, cooperates with the rails to fix adjacent dispensers relative to each other. To mount an upper dispenser on a lower dispenser, the door on the lower dispenser is opened, the complementary rails of the respective dispensers are interlocked and the upper dispenser is slid forwardly on the lower dispenser until it engages stops on the upper rails of the lower dispenser. To thereafter lock the upper dispenser in fixed position on the lower dispenser, the door of the lower dispenser is closed to block sliding movement between the dispensers. Locking the door of the lower dispenser then effectively prevents unauthorized personnel from separating the interconnected dispenser units.

More particularly, the invention provides a ticket dispenser apparatus including a plurality of ticket dispenser units assembled in adjacent relation to one another and means for interconnecting adjacent dispenser units to selectively prevent adjacent dispenser units from being disassembled from one another. The means for interconnecting adjacent dispenser units includes means for interlocking adjacent dispenser units for limited movement relative to one another, and means for selectively further restricting this limited movement.

The invention also provides a ticket dispenser apparatus including a first dispenser unit including a first rail and a second dispenser unit including a second rail engageable with the first rail to interlock the first and second dispenser units for relative sliding movement therebetween. Means associated with at least one of the first and second dispenser units is provided for selectively restricting sliding movement therebetween, when the first and second dispenser units are interlocked, to prevent the first and second rails from being disengaged.

The invention also provides a ticket dispenser apparatus including a plurality of dispenser units assembled in stacked relation to one another. Each dispenser unit includes a container adapted to receive tickets, a door supported on the container for movement between opened and closed positions relative to the container, and means for selectively interconnecting the container in fixed relation with respect to the container of an adjacent dispenser unit. The means for interconnecting is associated with the door such that the container is interconnected in fixed relation with the container of the adjacent dispenser unit when the door is closed, and is moveable relative to the container of the adjacent dispenser unit when the door is opened.

The invention further provides a ticket dispenser capable of being positioned in stacked relation with other identical ticket dispensers. The dispenser includes a container having a top surface and a bottom surface, a first rail extending upwardly from the top surface, and a second rail extending downwardly from the bottom surface. The second rail is complementary to the first rail so as to be adapted to engage the first rail of another dispenser to interlock the container with the container of the other dispenser for relative sliding movement therebetween. The dispenser includes a door supported on the container for movement between opened and closed positions, such that the door, when in the closed position, extends above the top surface of the container. When closed, the door is engageable with the other dispenser to limit sliding movement of the container relative to the container of the other dispenser.

Other features and advantages of the invention are set forth in the following description, claims and drawings.

BRIEF DESCRIPTION OF THE DRAWINGS

FIG. 3 is a perspective view of one of the stackable dispenser units employed in the assembly illustrated in FIG. 2.

FIG. 4 is a top plan view of the dispenser unit illustrated in FIG. 3.

FIG. 5 is a front elevational view, partially cutaway and in section, of the dispenser unit illustrated in FIG. 3.

FIG. 6 is a side elevational view of the dispenser unit illustrated in FIG. 3.

FIG. 7 is an enlarged sectional view of a portion of the dispenser assembly illustrated in FIG. 2 and shown with the door of the middle dispenser unit in a closed position.

FIG. 8 is an enlarged front elevational view of a portion of the dispenser apparatus illustrated in FIG. 1

FIG. 9 is a sectional view taken along line 9—9 in FIG. 8.

FIG. 10 is a perspective view of the mounting member illustrated in FIG. 8.

Figures 1, 2:
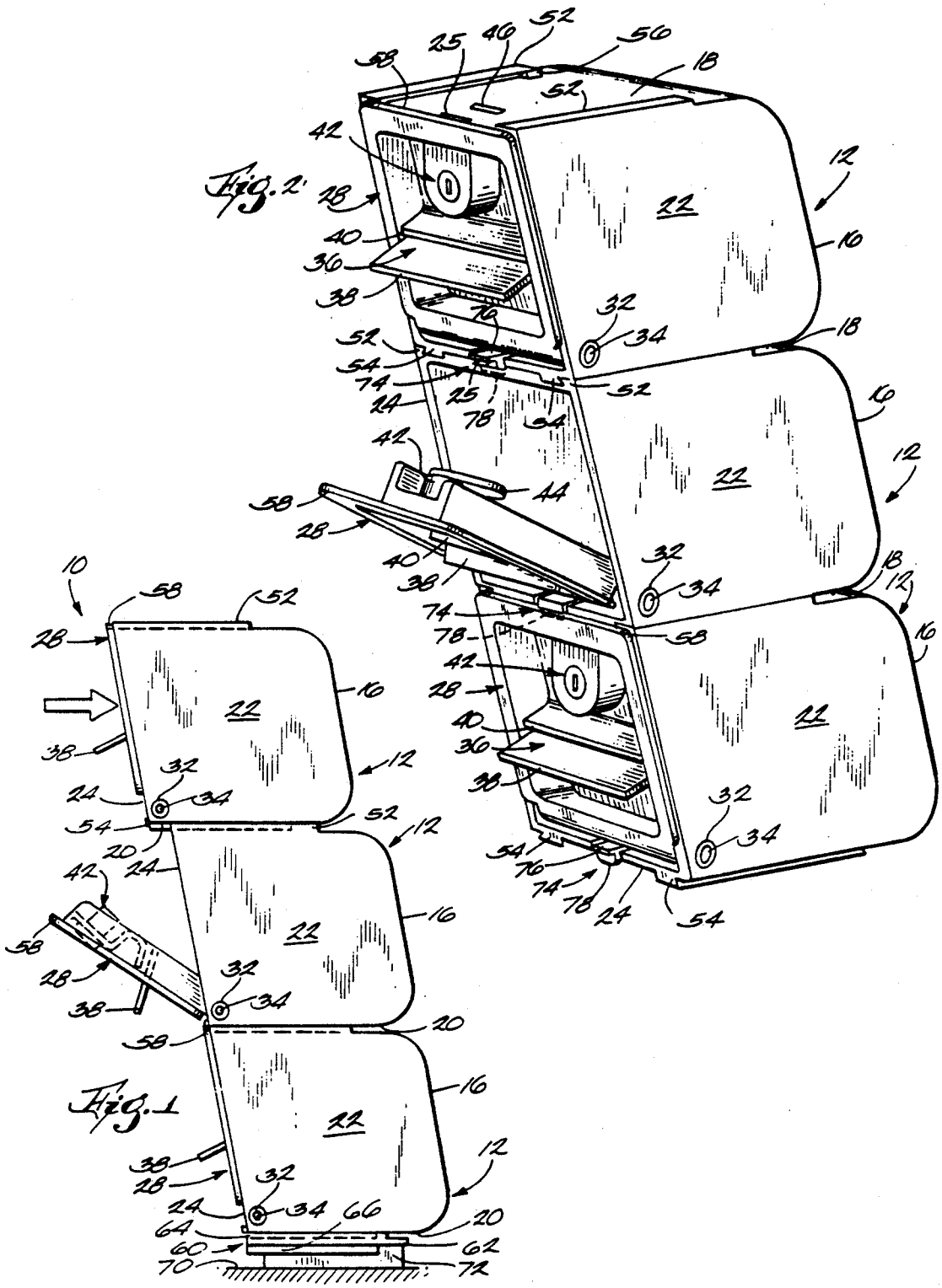
FIG. 1 is a side elevational view of a partially assembled dispenser apparatus embodying various features of the invention.
FIG. 2 is a perspective view of the assembled dispenser units illustrated in FIG. 1.

Before one embodiment of the invention is explained in detail, it is to be understood that the invention is not limited to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

GENERAL DESCRIPTION

Illustrated in the drawings is a dispenser apparatus 10 embodying various features of the invention. While the dispenser apparatus 10 is preferably employed in connection with the sale of lottery game tickets and the like, it will be understood by those skilled in the art that the dispenser apparatus 10 could be adapted for use in other applications as well.

As shown in FIG. 1, the dispenser apparatus 10 includes a plurality of interconnected dispenser units 12 (three are shown) arranged in vertically stacked relation to one another. As is more fully explained below, the dispenser units 12, when properly assembled in stacked relation, are locked together to prevent unauthorized personnel from separating the units 12.

The dispenser units 12 are preferably modular for interchangeability and each is individually constructed to display and dispense lottery tickets. More specifically, as shown in FIGS. 3–6, each dispenser unit 12 includes a generally box-like container 14 having a front wall 16, a top wall 18, a bottom wall 20, opposite side walls 22 and a planar rear surface 24 formed by the rear edges of the top, bottom and side walls 18, 20 and 22. The top wall 18 is provided with a slot 25 for reasons explained hereinafter. The container 14 is used to store and display a series of interconnected tickets 26 (FIG. 7) arranged in folded stacks so as to be viewable through the front wall 16 of the container 14. While other materials could be used, the container 16 is preferably molded of a polycarbonate material for transparency and toughness. An example of a suitable polycarbonate material is sold under the name LEXAN.

To permit access to the interior of the container 14, each dispenser unit 12 includes a rear door 28. The door 28 is also preferably molded of a polycarbonate material and includes a cylindrical tube portion 30 into which bushing members 32 are inserted through holes in the side walls 22 of the container 14. The bushing members 32 support the door 28 for pivotal movement between opened and closed positions and are held in place by plugs 34 inserted into each of the bushing members 32.

To dispense the tickets 26, the door 28 is provided with a lateral slot 36 defined between outwardly projecting lips 38 and 40 through which the tickets 26 can be withdrawn. If desired, the lips 38 and 40 can bear against one another so that the interconnected ticket series is gripped to prevent retraction back into the container 14.

To prevent unauthorized personnel from opening the door 28, each dispenser unit 12 is provided with mean for locking its door 28 in the closed position. While various locking means can be employed, in the illustrated arrangement such means includes a key operated lock mechanism 42 mounted on the door 28. As shown best in FIG. 7, the lock mechanism 42 includes a locking bar 44 which is pivoted when the key (not shown) is turned. A stop member 46 is received in a frusto-conically shaped aperture 48 in the top wall 18 of the container 14 and extends downwardly into the container 14 so that when the locking bar 42 is pivoted upwardly it abuts the stop member 48 to prevent the door 28 from opening.

The dispenser apparatus 10 also includes means for interconnecting adjacent dispenser units 12 to selectively prevent the adjacent units from being disassembled from one another. In the illustrated arrangement, the interconnecting means includes means on each dispenser unit 12 for interlocking that dispenser unit for movement relative to one or more adjacent dispenser units 12. While various interlocking means can be employed, in the illustrated construction such means includes first and second sets of complementary rails on each dispenser unit 12. As shown in FIG. 2, the sets of rails of each dispenser unit 12 are respectively engageable in mating relation with the complementary sets of rails on adjacent upper and lower dispenser units 12 to interlock the units for relative sliding movement.

More specifically, the first set of rails includes a pair of spaced apart upper rails 52 extending upwardly from the top wall 18 of the container 14, and the second set of rails includes a pair of spaced apart lower rails 54 extending downwardly from the bottom wall 20 of the container 14. The upper and lower rails 52 and 54 are all generally wedge-shaped, but the lower rails 54 are inverted relative to the upper rails 52 so that the lower rails 54 are insertable between the upper rails 52 of an adjacent dispenser unit 12 in dovetail-like fashion. When upper and lower rails 52 and 54 of adjacent dispenser units 12 are engaged (see FIGS. 2 and 8), the wedge configuration of the rails interlocks the units 12 for relative movement limited to forward and rearward sliding movement along the path of engagement of the mating upper and lower rails 52 and 54.

As shown in FIG. 3, the upper rails 52 are each provided with a stop portion 56 at the forwardmost end thereof. When an upper dispenser unit 12 is slid to its fully engaged or forwardmost position on a lower adjacent dispenser unit 12 (i.e. the lower rails 52 of the upper dispenser unit 12 engage the stop portions 56 on the lower dispenser unit 12), the rear surfaces 24 of the adjacent dispenser units 12 are preferably coplanar. This relationship is shown by the lower two dispenser units 12 illustrated in FIG. 1. The front walls 16 of adjacent dispenser units 12 are also preferably coplanar when the units 12 are fully engaged to provide the dispenser apparatus 10 with a planar front surface through which the tickets 26 are viewed.

To prevent the interlocked rails 52 and 54 of adjacent dispenser units 12 from being disengaged to disassemble the dispenser apparatus 10, the means for interconnecting adjacent dispenser units 12 also includes means for selectively restricting relative movement between the adjacent dispenser units 12. While various movement restricting means can be used, in the illustrated arrangement such means is associated with the door 28 of each dispenser unit 12.

As shown best in FIG. 7, the door 28 includes an extended portion 58 which, when closed, extends upwardly above the top wall 18 of the dispenser unit 12 to substantially cover the intervening space between that dispenser unit 12 and an upper dispenser unit 12. In this position, the door 28 intersects the path of engagement of the mating upper and lower rails 52 and 54 of the adjacent upper and lower dispenser units 12 to confine the lower rails 54 of the upper unit 12 between the extended door portion 58 and the stop portions 46 of the lower unit 12. Thus, the door 28 of a dispenser unit 12 must remain open while another dispenser unit 12 is being placed thereon or disassembled therefrom. In the preferred embodiment, when an upper dispenser unit 12 is in its fully engaged position on a lower dispenser unit 12, the door 28 and the stop portions 46 of the lower unit prevent any sliding movement between the adjacent units. Accordingly, the interlocked rails 52 and 54 of adjacent upper and lower dispenser units 12 and the doors 28 cooperate to fix the units 12 in stacked relation when the doors 28 of the units 12 are closed.

To support an assembled group of dispenser units 12, the dispenser apparatus 10 also includes an optional mounting member 60. As shown in FIG. 10, the mounting member 60 includes a base plate 62 having upper and lower rails 64 and 66 which are preferably identical to the upper and lower rails 52 and 54 on the dispenser units 12. This permits a dispenser unit 12 to be slid onto the mounting member 60 in the same manner in which it can be slid onto another dispenser unit 12.

Means are provided to secure the mounting member 60 to a support surface. While various mechanical means can be employed, in the illustrated arrangement a mounting pad 72 having adhesive material on its opposite sides is used. As shown in FIG. 8, the pad 72 is adhered to the lower surface of the base plate 62 to mount the dispenser units 12 on top of a support surface 70. If desired, the pad 72 could alternatively be adhered to the upper surface of the base plate 62 to suspend the dispenser units 12 from a surface.

The dispenser apparatus 10 also includes means for locking or securing an individual dispenser unit 12 in fixed relation on the mounting member 60. While various locking means can be used, in the illustrated arrangement a locking means is provided on each dispenser unit 12 and includes a locking member 74 molded integrally with the bottom wall 20 of the dispenser unit 12. The locking member 74 includes a resilient arm portion 76 and a locking tongue or tab 78 extending downwardly from the arm portion 76. As shown in FIGS. 5 and 6, in its normal, unflexed position, the arm portion 76 is generally coplanar with the bottom wall 20 and the locking tab 78 extends to a point below the level of the lower rails 54. The mounting member 60 is also provided with a locking member 80 formed integrally with the base plate 62. The locking member 80 includes a slot 82 in the top side thereof, but is otherwise configured identically to the locking members 74 on the dispenser units 12.

To secure a dispenser unit 12 on top of the mounting member 60, the lower rails 54 on the dispenser unit 12 and the upper rails 64 of the mounting member 60 are first engaged. The dispenser unit 12 is then slid to its forwardmost position on the mounting member 60 (see FIG. 1). As the dispenser unit 12 approaches this position the locking member 74 thereon, and particularly the locking tab 78, engages the locking member 80 of the mounting member 60 and slides therealong until the locking tab 78 is brought into registry with the slot 82. The locking tab 78 thereafter snaps into the slot 82 to secure the dispenser unit 12 on the mounting member 60. To release the dispenser unit 12, the locking member 74 is manually raised to remove the locking tab 78 from the slot 82 and the dispenser unit 12 is then slid rearwardly off the mounting member 60. Similarly, if it is desired to suspend a dispenser unit 12 from the mounting member 60, the upper rails 52 on the dispenser unit 12 and the lower rails 66 of the mounting member 60 are first engaged. The dispenser unit 12 is then slid rearwardly relative to the mounting member 60 until the locking tab of the locking member 80 snaps into the slot 25 in the dispenser unit 12.

When not used in conjunction with the mounting member 60, the locking members 74 of the dispenser units 12 function primarily to aid in positioning dispenser units 12 in stacked relation. As an upper dispenser unit 12 is slid onto a lower dispenser unit 12, the locking member 74 of the upper unit is flexed upwardly so that the locking tab 78 thereon clears the rear edge of the top wall 18 of the lower dispenser unit 12. This can be accomplished either manually or through engagement of the locking tab 78 with the top wall 18. The locking tab 78 then automatically snaps into the slot 25 in the lower dispenser unit 12 when brought into registry therewith.

While in the illustrated construction the locking members 74 are not contemplated as the primary means for locking the dispenser units 12 in stacked relation, in other arrangements the locking members 74 could serve as the primary locking means. In such an alternative arrangement, it is possible that the extended door portions 28 and/or the stop portions 46 could be replaced by the locking members 74, or that the door portions 28 could function primarily to restrict access to the locking members 74 when the doors 28 are closed.

To assemble the dispenser apparatus 10, the mounting member 60 is first secured to a desired support surface via the mounting pad 72. A first dispenser unit 12 is then mounted on the mounting member 60 in the manner described above. To stack a second dispenser unit 12 on the first dispenser unit 12, the door 28 of the first unit 12 is unlocked and opened to permit the lower rails 54 of the second unit 12 to be slid into interlocked engagement with the upper rails 54 of the first unit 12. The second dispenser unit 12 is then slid forwardly on the first dispenser unit 12 until it engages the stop portions 56 on the first unit 12 or until the locking tab 78 of the second unit 12 snaps into the slot 25 in the first unit 12. Thereafter, the door 28 of the first dispenser unit 12 is closed and locked to prevent unauthorized personnel from opening the first unit 12 or disassembling the first and second dispenser units 12 from each other. Additional dispenser units 12 can be added to the arrangement in a similar fashion until the desired display size is reached.

Advantageously, the invention provides dispenser units 12 that can be arranged in stacked relation relative to one another to selectively increase or decrease display and dispensing capabilities. Additionally, the dispenser units 12 are configured to cooperate with each other to prevent unauthorized disassembly of the dispenser apparatus 10.

Other features and advantages of the invention are set forth in the following claims.

I claim:

1. A ticket dispenser apparatus comprising:

a plurality of ticket dispenser units assembled in an adjacent relation to one another, each of said adjacently related dispenser units including a door pivotable between an opened position and a closed position, and means for interconnecting said adjacently related dispenser units to selectively prevent said adjacently related dispenser units from being disassembled from one another, the means for interconnecting including means for interlocking said adjacently related dispenser units, said means for interlocking allowing for sliding movement relative to one another while interlocked, and means for selectively restricting said sliding movement between said adjacently related dispenser units, the means for selectively restricting said sliding movement including the door of at least one of said adjacently related dispenser units, the door of said at least one of said adjacently related dispenser units, when in the closed position, being engageable with an another of said adjacently related dispenser units to restrict sliding movement between said at least one of said adjacently related dispenser units and said other of said adjacently related dispenser units.

2. A ticket dispenser apparatus as set forth in claim 1 wherein the means for interlocking said adjacently related dispenser units includes a plurality of rails, each of said adjacently related dispenser units including one of the rails, and wherein the rail of each one of said adjacently related dispenser units is engageable with the rail of an another one of said adjacently related dispenser units to interlock those dispenser units for sliding movement relative to one another.

3. A ticket dispenser apparatus as set forth in claim 1 wherein the means for interlocking said adjacently related dispenser units includes a plurality of rails including first rails and second rails, each of said adjacently related dispenser units including one of the first rails and one of the second rails, the first rail of said at least one of said adjacently related dispenser units being engageable with the second rail of said other of said adjacently related dispenser units to interlock those dispenser units for sliding movement relative to one another.

4. A ticket dispenser apparatus as set forth in claim 3 wherein the first rail of each of said adjacently related dispenser units includes a stop portion, and wherein the second rail of said other of said adjacently related dispenser units, when engaged with the first rail of said at least one of said adjacently related dispenser units, is confined between the stop portion of said first rail of said at least one of said adjacently related dispenser units and the door of said at least one of said adjacently related dispenser units when that door is in its closed position.

5. A ticket dispenser apparatus as set forth in claim 3 wherein the dispenser apparatus further comprises a mounting member for supporting said adjacently related dispenser units on a support surface, the mounting member including a base plate, and a mounting rail engageable with one of the first and second rails of one of said adjacently related dispenser units to interlock said one of said adjacently related dispenser units and the mounting member for relative sliding movement therebetween, and wherein one of said one of said adjacently related dispenser units and the mounting member includes a locking member engageable with the other of said one of said adjacently related dispenser units and the mounting member to fix said one of said adjacently related dispenser units on the mounting member.

6. A ticket dispenser apparatus comprising:

a first dispenser unit including a first rail, a second dispenser unit including a second rail engageable with the first rail to interlock the first and second dispenser units for relative sliding movement therebetween, and a door pivotable between an opened position in which access to an interior of the second dispenser is permitted, and a closed position in which access to the interior of the second dispenser is denied, the door, when in the closed position, being engageable with the first dispenser unit to restrict sliding movement between the dispenser units.

7. A ticket dispenser apparatus as set forth in claim 6 wherein, when the first and second rails are engaged, the sliding movement of the first dispenser unit relative to the second dispenser unit is limited to sliding movement along a path of engagement of the first and second rails in a first direction and in a second direction opposite the first direction, and wherein the door includes an extension which, when the door is closed, intersects the path of engagement of the rails to restrict the sliding movement of the first dispenser unit in the first direction relative to the second dispenser unit.

8. A ticket dispenser apparatus as set forth in claim 6 wherein the door includes a means for locking the door in the closed position to prevent the first and second rails from being disconnected.

9. A ticket dispenser apparatus comprising:

a plurality of dispenser units, each of the dispenser units including a container defining an interior space for receiving tickets, and a door supported on the container for pivotal movement between an opened position and a closed position, and means for selectively interconnecting the dispenser units in a substantially fixed relation to each other, the means for selectively interconnecting including the doors of the dispenser units, each one of the dispenser units being interconnected in substantially fixed relation with another one of the dispenser units when the door of said another one of the dispenser units is in the closed position, and being moveable relative to said another one of the dispenser units when the door of said another one of the dispenser units is in the opened position.

10. A ticket dispenser apparatus as set forth in claim 9 wherein the means for selectively interconnecting includes first and second sets of rails on the container of each of the dispenser units, the first set of rails of said one of the dispenser units being engageable in interlocking relation with the second set of rails of said another of the dispenser units to interconnect said one of the dispenser units and said another of the dispenser units for relative sliding movement therebetween.

11. A ticket dispenser apparatus as set forth in claim 10 wherein the sets of rails interconnecting said one of the dispenser units with said another one of the dispenser units define a path of engagement along which the sliding movement of said one dispenser unit relative to said another one of the dispenser units is limited, and wherein the door of one of said one dispenser unit and said another dispenser unit includes an extension which, when that door is closed, intersects the path of engagement to restrict relative sliding movement between said one dispenser unit and said another dispenser unit.

12. A ticket dispenser apparatus comprising:

a first dispenser unit including a first rail, the first rail including a stop portion, and a door supported for movement between an opened position and a closed position, a second dispenser unit including a second rail engageable with the first rail to interlock the first and second dispenser units for relative sliding movement therebetween, and means for selectively restricting the sliding movement between the first and second dispenser units, when the first and second dispenser units are interlocked, to prevent the first and second rails from being disengaged, the means for selectively restricting sliding movement between the first and second dispenser units including the door which, when in the closed position, is engageable with the second dispenser unit to restrict the sliding movement between the first and second dispenser units, and the stop portion, the second rail being engageable with the stop portion to further restrict the sliding movement between the first and second dispenser units such that the second dispenser unit is substantially fixed relative to the first dispenser unit.

13. A ticket dispenser apparatus comprising:

a first dispenser unit including a first rail, a second dispenser unit including a second rail engageable with the first rail to interlock the first and second dispenser units for relative sliding movement therebetween, and means for selectively restricting the sliding movement between the first and second dispenser units, when the first and second dispenser units are interlocked, to prevent the first and second rails from being disengaged, the means for selectively restricting sliding movement between the first and second dispenser units including a locking member on one of the first and second dispenser units, the locking member being engageable with the other of the first and second dispenser units to prevent the sliding movement between the first and second dispenser units, and a door on one of the first and second dispenser units, the door being supported for movement between an opened position and a closed position, and the door, when in the closed position, restricting access to the locking member to prevent the first and second rails from being disengaged.

14. A ticket dispenser apparatus comprising:

a first dispenser unit including an upper rail, a lower rail, and a locking member a second dispenser unit including a rail engageable with one of the upper and lower rails to interlock the first and second dispenser units for relative sliding movement therebetween, and means for selectively restricting the sliding movement between the first and second dispenser units, when the first and second dispenser units are interlocked, to prevent the one of the upper and lower rails and the rail of the second dispenser unit from being disengaged, and means for mounting the first dispenser unit on a support surface, the means for mounting including a base plate, the base plate including upper and lower rails, the upper rail on the base plate being engageable with the lower rail on the first dispenser unit and, alternatively, the lower rail on the base plate being engageable with the upper rail on the first dispenser unit, to interlock the first dispenser unit and the base plate for relative sliding movement therebetween, and a locking member, the locking member of one of the first dispenser unit and the base plate being engageable with the other of the first dispenser unit and the base plate when the lower rail of the first dispenser unit is engaged with the upper rail of the base plate to fix the first dispenser unit on the base plate, and the locking member of said other of the first dispenser unit and the base plate being engageable with said one of the first dispenser unit and the base plate when the upper rail of the first dispenser unit is engaged with the lower rail of the base plate to fix the first dispenser unit on the base plate.

* * * * *